US006607223B1

(12) United States Patent
Mastro

(10) Patent No.: US 6,607,223 B1
(45) Date of Patent: Aug. 19, 2003

(54) MOLDED MAGNETIC CATCH ASSEMBLY

(75) Inventor: Paul F. Mastro, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 63 days.

(21) Appl. No.: 09/686,278

(22) Filed: Oct. 12, 2000

(51) Int. Cl.[7] ..... E05C 19/16
(52) U.S. Cl. ..... 292/251.5; 292/DIG. 19
(58) Field of Search ..... 292/251.5, DIG. 19, 292/DIG. 15

(56) References Cited

U.S. PATENT DOCUMENTS 2,240,035 A * 4/1941 Catherall ..... 292/2
2,943,881 A * 7/1960 Duhm ..... 292/251.5
3,539,214 A * 11/1970 Fisher ..... 292/144
4,453,294 A * 6/1984 Morita ..... 24/303
4,995,655 A * 2/1991 Freeman ..... 292/251.5
5,926,671 A * 7/1999 Leibman ..... 399/110

* cited by examiner

*Primary Examiner*—J. J. Swann
*Assistant Examiner*—Matthew E. Rodgers
(74) *Attorney, Agent, or Firm*—Perman & Green, LLP

(57) ABSTRACT

A magnetic catch assembly for securely holding a door or cover on a machine in a closed position. The assembly comprises a unitary, injection molded, plastic member at least one portion of the member being magnetized to form the magnetic catch and at least one portion of the molded unitary member forming a mounting bracket adapted to securely mount the magnetic catch assembly to the machine.

6 Claims, 4 Drawing Sheets

MOLDED MAGNETIC CATCH ASSEMBLY

BACKGROUND OF THE INVENTION

1. Field of the Invention

This invention relates to a magnetic catch assembly, and more particularly, to a molded, one piece, magnetic catch assembly which can assist in keeping a machine cover, particularly a cover on an electrophotographic printing machine, closed.

2. Description of the Prior Art

In a typical electrophotographic printing processor as employed in an electrophotographic printing machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. Especially in view of all the moving parts and various processes that occurs in this type of printing machine, and further in view of the need to clear paper jams or conduct different type of repairs on the machine, the need to easily open and firmly close service type doors on this kind of machine is readily apparent. Conventional latch or locking systems, such as mechanical latches or locks provide positive latching for these types of doors. However, mechanical latches for this purpose are relatively expensive. In addition, when it is desired to open and close these doors quickly, one discovers that mechanical latches release too slowly. There is therefore a need to provide a latch or a locking mechanism for a door or cover typically used on such a machine to avoid the disadvantages described above and which offers certain advantages especially in view of the frequent need to obtain access to the interior portions of such machines.

Magnetic catches are widely used on a variety of electrophotographic printers to maintain a good level of operator access to the interior portion of the printer through doors that are kept closed by exerting a magnetic force on a metal striker plate or other adjacent metal part of the printing machine. As illustrated in the prior art structure shown in FIGS. 2A and 2B, magnetic catches are typically manufactured of a multipiece assembly 10, consisting of (i) a metal magnet 11, (ii) a pair of retainer plates 12 used to hold the magnet in place in assembly 10 and (iii) a separate mounting bracket 14 having openings 15. The bracket 14 is used to mount the magnet to the machine by securing the bracket to the machine such as by the use of nails or screws fitted through openings 15.

Accordingly, it is a primary advantage of this invention to provide a new and improved structure for a magnetic catch assembly which avoids the disadvantages referred to above. It is a primary objective of this invention to provide a relatively inexpensive, easily manufactured and quickly operable latching mechanism in the forum of a magnetic catch assembly for keeping a door or cover of a machine closed. It is also a primary object of the present invention to provide a magnetic catch assembly whose components can be combined into a one piece molding. Meeting these objectives will result (i) in a significant reduction in the overall cost to manufacture a magnetic catch assembly, (ii) provide more design flexibility and (iii) enable magnetic catch assembly to be manufactured in an easier fashion. The present invention will not only exhibit all of these results but will provide increased design flexibility in that the designer is no longer limited to a design for a simple single flat magnet for closing a door. In accordance with the advantages of the present invention one can manufacture a contoured, stepped or corner shaped and magnet, and incorporate attachment features such as snap fits into a magnetic catch or manufacture a one piece double or multi magnetic catch assembly.

Additional advantages of the invention will be set forth in part in the description which follows, and some will be obvious from the description, or may be learned by practice of the invention in accordance with the various features and combinations as particularly pointed out in the appended claims.

SUMMARY OF THE INVENTION

All of the foregoing advantages and others will be attained by employing a magnetic catch assembly for securely holding a door on a machine in a closed position comprising a unitary, injection molded, plastic member, at least one portion of the member being magnetized to form the magnetic catch and at least one portion of the unitary molded member forming a mounting bracket that is adapted to securely mount the magnetic catch assembly to the machine. At least two separate areas of the unitary member can include magnetic members. Furthermore, at least one snap fit member can be unitarily molded as part of the catch assembly and included as part of the overall assembly. The snap fit member is adapted to further secure the assembly to the machine and can additionally be used to secure other components or subassemblies to the machine.

In accordance with the features of the present invention, an example of one type of machine that can incorporate the magnetic catch assembly as described herein is an electrophotographic printing machine. When the features of the present invention are used in such a machine the magnetic catch assembly of this invention is secured to the frame of the machine.

BRIEF DESCRIPTION OF THE DRAWINGS

The accompanying drawings which are incorporated in and constitute a part of the specification illustrate one embodiment of the present invention and, together with the following detailed description, serve to explain the principles of the present invention.

DETAILED DESCRIPTION OF THE PREFERRED EMBODIMENT

While the present invention will hereinafter be described in connection with preferred embodiments thereof, it will be understood that it is not intended to limit the invention to those embodiments. On the contrary, it is intended to cover all alternatives, modifications, and equivalents, as may be included within the spirit and scope of the invention as defined by the appended claims. For a general understanding of the features of the present invention, reference is made to the drawings. For a general understanding of some of the features of the present invention it is important to understand the type of environment that features in accordance with the present invention can be used. In that regard it will become evident that the magnetic catch assembly of the present invention is equally well suited to be used in a very large number of different machines with doors including, for example, reprographic printing machines. The magnetic catch assembly of the present invention is not necessarily limited in its application to use in an electrophotographic printing machine as shown herein or described below or even limited to use in a printing machine. The purpose of describing the various parts of an electrophotographic machine is simply to illustrate as an example the various parts of a machine that needs to be reached for servicing. Just about any door or cover used on the electrophotographic machine described below can be used to reach the various parts described below and secured and kept in a closed position by using the features of the present invention. In fact, by using as an electrophotographic printer as an example of an apparatus that can employ the magnetic catch assembly as defined by this invention there is no intent to limit the magnetic catch assembly of this invention for use this kind of machine. Quite the opposite is true. The magnetic catch assembly of the present invention can be used in just about any machine that has doors or covers for the purpose of keeping such doors or covers in a closed position.

Figure 1:
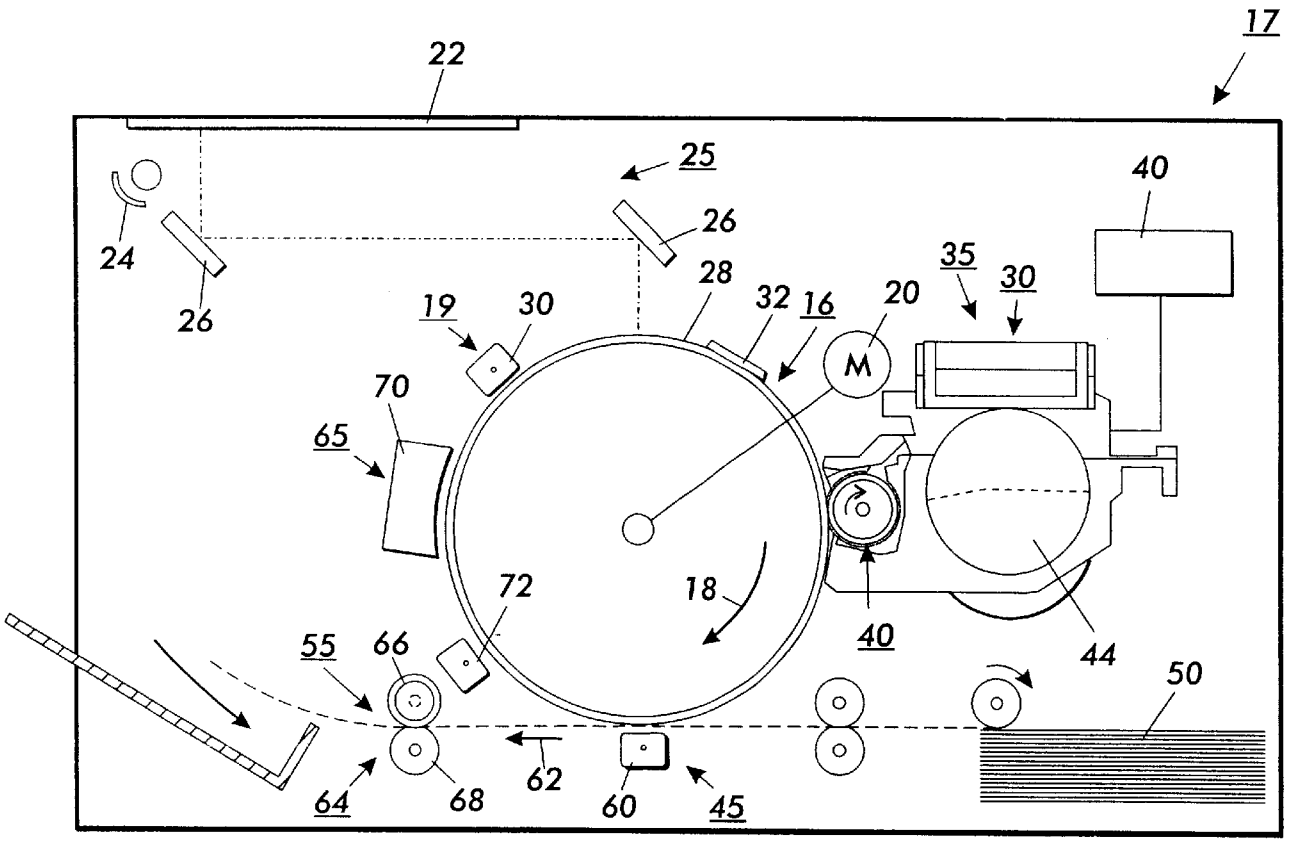
FIG. 1 is a partially schematic plan view of a typical reprographic printing apparatus that can incorporate the features of the present invention.

Inasmuch as the art of electrophotographic printing is well known, the various processing stations employed in the FIG. 1 printing machine will be shown hereinafter schematically and their operation described briefly with reference thereto. Referring now to FIG. 1, the electrophotographic printing machine 17 shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 in the direction of arrow 18. Drum 16 is coupled to motor 20 by suitable means such as a drive mechanism. If a electrophotographic printer employs a photoconductive belt it is preferably made from a photoconductive material coated on a grounding layer, which, in turn, is coated on an anti-curl backing layer. The photoconductive material is made from a transport layer coated on a generator layer. The transport layer transports positive charges from the generator layer. An interface layer is coated on the grounding layer. The transport layer contains small molecules of di-m-tolydiphenylbiphenyldiamine dispersed in a polycarbonate.

The generation layer is preferably made from trigonal selenium. The grounding layer is preferably made from titanium coated MYLAR. The grounding layer is very thin and allows light to pass therethrough. Other suitable photoconductive materials, grounding layers, and anti-curl backing layers may also be employed.

Initially successive portions of drum 16 pass through charging station 19. At charging station 19, a corona generating device, indicated generally by the reference numeral 30, charges the drum 16 to a selectively high uniform electrical potential, preferably negative. Any suitable control, well known in the art, may be employed for controlling the corona generating device 30.

A document to be reproduced is placed on a platen 22, located at imaging station 25, where it is illuminated in a known manner by a light source such as a tungsten halogen lamp 24. The document thus exposed is imaged onto the drum 16 by a system of mirrors 26, as shown. The optical image selectively discharges surface 28 of the drum 16 in an image configuration to the document whereby an electrostatic latent image 32 of the original document is recorded on the drum 16 at imaging station 25.

At development station 35, a magnetic development system or unit, indicated generally by the reference numeral 30 advances developer materials into contact with the electrostatic latent images. Preferably, the magnetic developer unit includes a magnetic developer roll mounted in a housing. Thus, developer unit 30 contains a developer roll which advances toner particles into contact with the latent image. Appropriate developer biasing may be accomplished via power supply 40 electrically connected to developer unit 30.

The developer unit 30 develops the charged image areas of the photoconductive surface. This developer unit contains magnetic black toner, for example, particles 44 which are charged by the electrostatic field existing between the photoconductive surface and the electrically biased developer roll in the developer unit. A power supply electrically biases the developer roll.

A sheet of support material 50 is moved into contact with the toner image at transfer station 45. The sheet of support material is advanced to transfer station 45 by a suitable sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute drum 16 in a timed sequence so that the toner powder image developed thereon contacts the advancing sheet of support material at transfer station 45.

Transfer station 45 includes a corona generating device 60 which sprays ions of a suitable polarity onto the backside of sheet 50. This attracts the toner powder image from the drum 16 to sheet 50. After transfer, the sheet continues to move, in the direction of arrow 62, onto a conveyor (not shown) which advances the sheet 50 to fusing station 55.

Fusing station 55 includes a fuser assembly, indicated generally by the reference numeral 64, which permanently affixes the transferred powder image to sheet 50.

Preferably, fuser assembly 64 comprises a heated fuser roller 66 and a pressure roller 68. Sheet 50 passes between fuser roller 66 and pressure roller 68 with the toner powder image contacting fuser roller 66. In this manner, the toner powder image is permanently affixed to sheet 50. After fusing, a chute, not shown, guides the advancing sheet 50 to a catch tray, also not shown, for subsequent removal from the printing machine by the operator. It will also be understood that other post-fusing operations can be included. For example, stapling, binding, inverting and returning the sheet 50 for duplexing, and the like.

After the sheet 50 of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station 65. The cleaner unit can include two brush rolls that rotate at relatively high speeds which create mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

The electrophotographic printing machine as described above is an example of a machine having the kind of environment that will use features of the present invention. Specifically, the outer cover of the machine described above and schematically illustrated in FIG. 1 includes a plurality of doors and/or covers (not shown) which enable either a user of the electrophotographic machine or a person who is servicing the machine to quickly and easily obtain access to any internal part of the machine such as, for example, the photoconductive drum 16 or any of the mechanisms which drive the drum; the charging station 19; the imaging station D; the development station 35; the transfer station 45; the fusing station 55; the finishing portion of the printer or any part other in any of these areas or any other part of the electrophotographic machine. Typically, magnetic catches are used to hold these access doors or covers firmly closed during the operation of the machine or at any time that access to any of the internal mechanisms is not needed or desired.

Figure 2A:
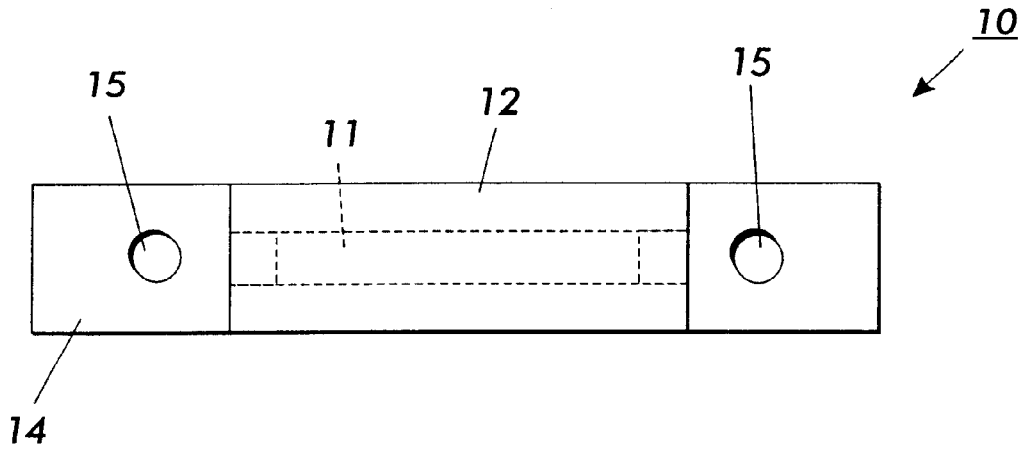
FIG. 2A PRIOR ART
FIG. 2A is a plan view of a magnetic catch as represented by the prior art.
Figure 2B:
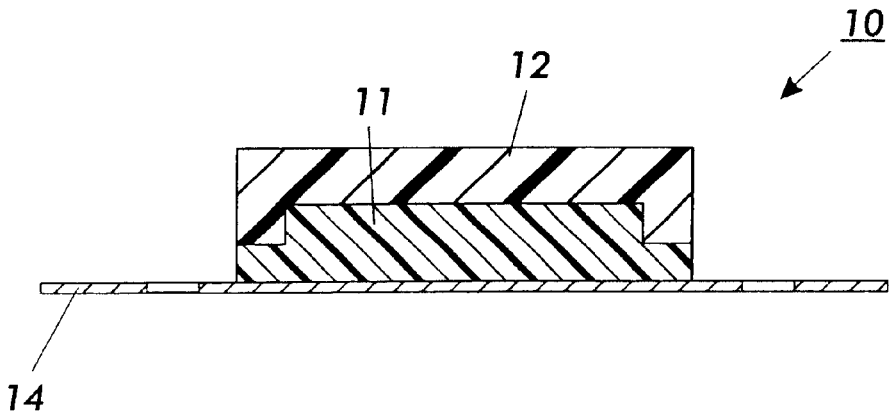
FIG. 2B PRIOR ART
FIG. 2B is a cross sectional plan view of the magnetic catch assembly of FIG. 2A.
Figure 3A:
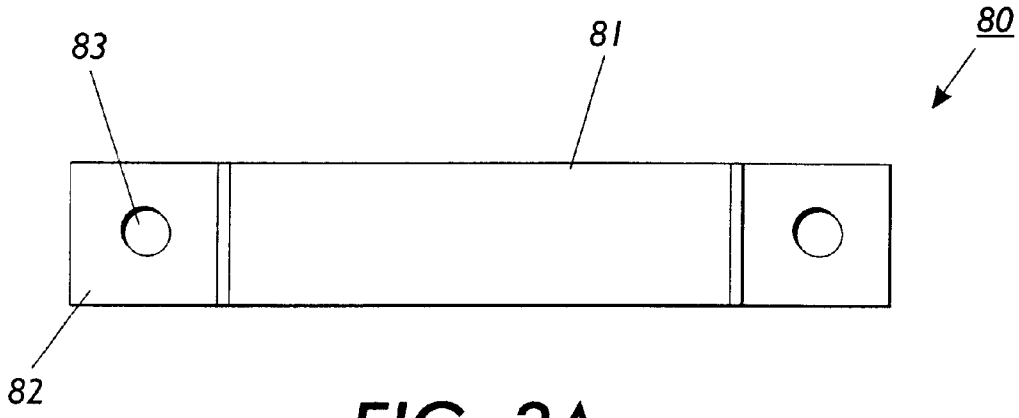
FIG. 3A illustrates a plan view of a magnetic catch in accordance with the features of the present invention.
Figure 3B:
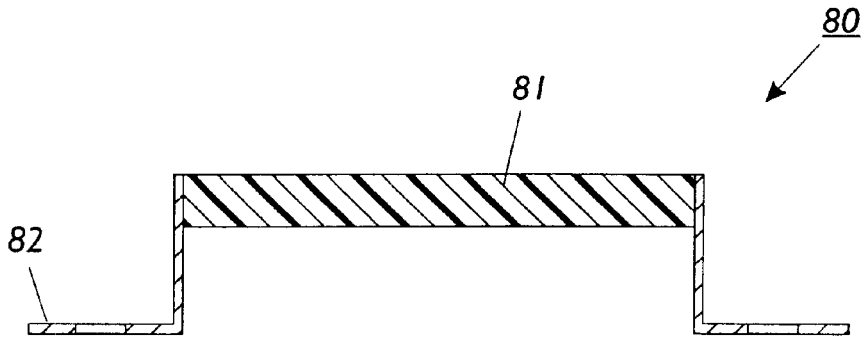
FIG. 3B is a cross sectional plan view of the magnetic catch assembly of FIG. 3A.

In accordance with the features of the present invention and as specifically illustrated in FIGS. 3A and 3B, the components of a magnetic catch assembly 80 are combined into a one piece, unitary injection molding utilizing ferrite molding compounds to form the magnetic catch assembly and preferably a magnetization technology as developed by the Xerox Corporation for magnetizing the assembly. For example molding and magnetizing a magnetic catch assembly can be done by following the teachings as contained in any of U.S. Pat. Nos. 5,795,532, or 5,894,004 or 6,000,922 the disclosures of which are all incorporated by reference in this application in their entirety. By utilizing the Xerox Corporation's magnetization technology with ferrite thermoplastic molding compounds, in accordance with the invention as described herein all the parts (i.e. 11, 12 and 14) of the prior art type magnetic catch assembly 10 as illustrated in FIG. 2 are combined into a one piece unitary molding. Selective areas 81 (one or more) of interest of the molding are magnetized in the mold as part of the forming process, and other areas are molded to form the mounting bracket 82 having, for example, openings 83 insertion of, a screw as mail to secure the magnetic catch assembly 80 to a machine frame. Following this technique will result in a significantly lower manufacturing cost for a magnetic catch assembly, and also a simplified part design along with an overall reduction in the number of parts required for such an assembly.

Figure 4A:
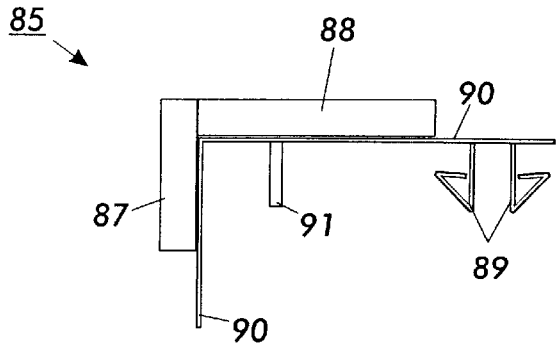
FIG. 4A and FIG. 4B are plan views of a magnetic catch assembly in accordance with the features of the present invention having molded snap fit elements.
Figure 4B:
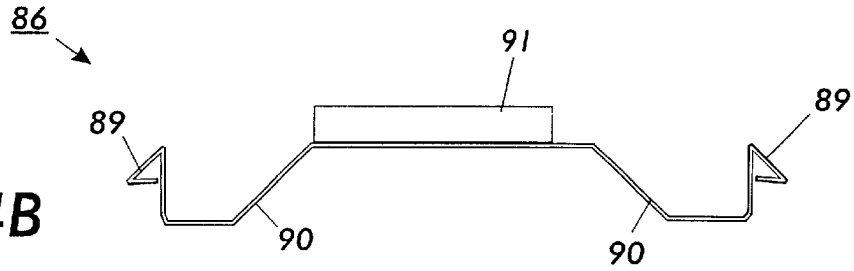

In FIGS. 4A and 4B there is illustrated embodiments for magnetic catch assemblies various in accordance with features of the present invention. Specifically, the unitary structure in FIG. 4A is a molded, one piece corner magnet assembly 85 having magnetic areas 87 and 88 that are arranged on the assembly in such a manner to accommodate a corner position within a machine. The corner magnetic catch assembly 85 can include snap fit members 89 which can be snap fit onto the machine frame so as to further secure the magnetic catch assembly 85 (FIG. 4A) or 86 (FIG. 4B) onto the of the machine. The snap fit members 89 extend from the mounting bracket portion 90 of the magnetic catch assembly 85 and 86. A further optional feature extending from magnetic catch assembly 85 is another mounting element 91 that can be used to further secure magnetic catch assembly 85 to a machine.

Figure 5:
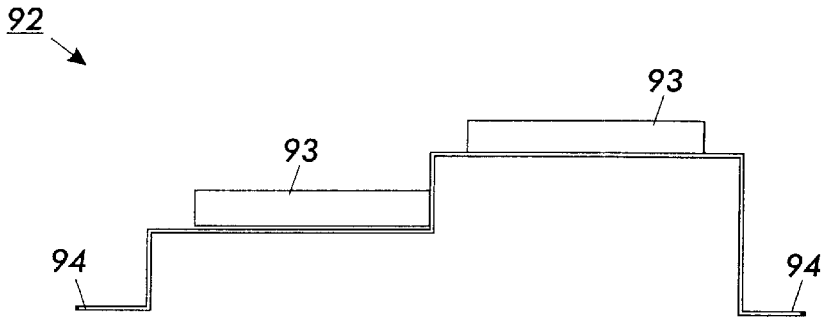
FIG. 5 is a plan view of a double magnetic catch assembly in accordance with the features of the present invention, i.e. having two separate magnetic areas.

Illustrated in FIG. 5 is still another embodiment of a magnetic catch assembly that incorporates the features of the present invention. There is shown a molded, one-piece, unitary double step magnetic catch assembly 92 which is specifically configured with two magnetic area 93, specifically for a situation where there are, for example double doors, i.e. two side-by-side doors which are to be held in a closed position by a magnetic catch assembly. The unitary structure includes mounting brackets 94 for securing the assembly 92 to a machine.

In accordance with the features of the present invention the injection molded, one piece, unitary magnetic catch assembly is preferably manufactured from a resin dispersed with a material that is capable of being magnetized. The resin may be any suitable thermoset or thermoplastic resin. For example, the thermoset resins may include phenolics or epoxies, may be a nylon or a polypropolene. The resins may be conductive or semiconductive. The level of magnetism of the resin is controlled by the amount or type of additive to the phenolic material i.e. the magnetically attractable filler material.

While this invention has been described in conjunction with specific embodiments thereof, it is evident that many alternatives, modifications, and variations will be apparent to those skilled in the art. Accordingly, the present invention is intended to embrace all such alternatives, modifications and variations that fall within the spirit and broad scope of the appended claims.

What is claimed is:

1. A magnetic catch assembly in combination with a machine for securely holding a door or cover positioned on the machine in a closed position comprising a unitary construction, molded, plastic member, at least one portion of the member being a magnetic catch formed of a dispersed magnetic material within the member and at least one portion of the member forming a mounting bracket adapted to securely mount the assembly to the machine.

2. A magnetic catch assembly according to claim 1 wherein said assembly is an injection molded assembly in the form of a unitary, one piece structure.

3. A magnetic catch assembly according to claim 1 wherein at least two separate portions of said unitary member comprises magnetic areas.

4. A magnetic catch assembly according to claim 1 wherein at lest two separate portions of said unitary member comprise magnetic areas, said magnetic areas lying perpendicular to one another.

5. A magnetic catch assembly according to claim 1 wherein said machine is an electrophotographic machine.

6. A magnetic catch assembly according to claim 4 wherein said assembly is secured to a frame of said machine by attaching said bracket to the frame.

* * * * *